US008602036B2

(12) United States Patent
Marquez et al.

(10) Patent No.: US 8,602,036 B2
(45) Date of Patent: Dec. 10, 2013

(54) SMOKING ARTICLES ENHANCED TO DELIVER ADDITIVES INCORPORATED WITHIN ELECTROSPUN MICROFIBERS AND NONOFIBERS, AND RELATED METHODS

(75) Inventors: Manuel Marquez, Midlothian, VA (US); Samuel Isaac Ogle, Richmond, VA (US); Zhihao Shen, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 987 days.

(21) Appl. No.: 11/878,741

(22) Filed: Jul. 26, 2007

(65) Prior Publication Data

US 2008/0149119 A1 Jun. 26, 2008

Related U.S. Application Data

(60) Provisional application No. 60/835,089, filed on Aug. 3, 2006.

(51) Int. Cl.
*A24B 15/28* (2006.01)

(52) U.S. Cl.
USPC ..... 131/332; 131/331; 131/334; 131/335

(58) Field of Classification Search
USPC ..... 131/341, 345, 332, 331, 334, 335
See application file for complete search history.

(56) References Cited

U.S. PATENT DOCUMENTS

| | | | | |
|---|---|---|---|---|
| 3,144,024 | A * | 8/1964 | Eichwald et al. | 131/274 |
| 3,939,848 | A * | 2/1976 | Le Roy | 131/344 |
| 4,821,750 | A * | 4/1989 | Browne | 131/345 |
| 4,869,275 | A * | 9/1989 | Berger | 131/332 |
| 4,971,078 | A | 11/1990 | Deutsch et al. | |
| 5,012,828 | A | 5/1991 | Hayes et al. | |
| 5,012,829 | A | 5/1991 | Thesing et al. | |
| 5,070,891 | A | 12/1991 | Rutherford | |
| 5,115,823 | A | 5/1992 | Keritsis | |
| 5,144,966 | A | 9/1992 | Washington | |
| 5,275,859 | A | 1/1994 | Phillips et al. | |
| 5,509,430 | A * | 4/1996 | Berger | 131/341 |
| 5,817,159 | A * | 10/1998 | Cahill et al. | 55/528 |
| 5,947,126 | A * | 9/1999 | Wilson et al. | 131/331 |
| 6,062,228 | A * | 5/2000 | Loercks et al. | 131/332 |
| 6,174,603 | B1 | 1/2001 | Berger | |
| 2002/0062833 | A1* | 5/2002 | Xue et al. | 131/331 |
| 2002/0100725 | A1 | 8/2002 | Lee et al. | |
| 2005/1013922 | | 6/2005 | Squires et al. | |

FOREIGN PATENT DOCUMENTS

| | | | |
|---|---|---|---|
| WO | WO2004/080217 | A | 9/2004 |
| WO | WO2006/116014 | A | 11/2006 |

OTHER PUBLICATIONS

Rutledge, G.C. et al, "Electrostatic Spinning and Properties of Ultrafine Fibers"; National Textile Center Annual Report: Nov. 2001.*

Doshi, Jayesh et al., "Electrospinning Process and Applications of Electrospun Fibers," Journal of Electrostatics, 35 (1995), pp. 151-160, Elsevier Science B.V.

Huang, Zheng-Ming et al., A review on polymer nanofibers by electrospinning and their applications in nanocomposites, Composites Science and Technology, 63 (2003), pp. 2223-2253, Elsevier Ltd.

Li, Dan et al., "Electrospinning of Nanofibers: Reinventing the Wheel?", Advanced Materials, 16, No. 14, Jul. 19, 2004, pp. 1151-1170, WILEY-VCH Verlag GmbH & Co. KGaA.

Sun, Zaicheng et al., "Compound Core-Shell Polymer Nanofibers by Co-Electrospinning," Advanced Materials, 15, No. 22, Nov. 17, 2003, pp. 1929-1932, WILEY-VCH Verlag GmbH & Co. KGaA.

Loscertales, I.G. et al., "Micro/Nano Encapsulation via Electrified Coaxial Liquid Jets," Science, vol. 295, Mar. 1, 2002, pp. 1695-1698.

Madhugiri, Sudha et al., "Electrospun MEH-PPV/SBA-15 Composite Nanofibers Using a Dual Syringe Method," J. Am. Chem. Soc., 2003, 125, pp. 14531-14538, American Chemical Society.

Yu, Jian H. et al., "Production of Submicrometer Diameter Fibers by Two-Fluid Electrospinning," Advanced Materials, 16, No. 17, Sep. 3, 2004, pp. 1562-1566, WILEY-VCH Verlag GmbH & Co. KGaA.

Loscertales, Ignacio G. et al., "Electrically Forced Coaxial Nanojets for One-Step Hollow Nanofiber Design," J. Am. Chem. Soc., 2004, 126, pp. 5376-5377. American Chemical Society.

Li, Dan et al., "Use of Electrospinning to Directly Fabricate Hollow Nanofibers with Functionalized Inner and Outer Surfaces," Small, 2005, 1, No. 1, pp. 83-86, WILEY-VCH Verlag GmbH & Co. KGaA.

Li, Dan et al., "Electrospinning Nanofibers as Uniaxially Aligned Arrays and Layer-by-Layer Stacked Films," Advanced Materials, 16, No. 4, Feb. 17, 2004, pp. 361-366. WILEY-VCH Verlag GmbH & Co. KGaA.

Sundaray, Bibekananda et al., "Electrospinning of continuous aligned polymer fibers," Applied Physics Letters, vol. 84, No. 7, Feb. 16, 2004, pp. 1222-1224, American Institute of Physics.

Xu, C.Y. et al., Aligned biodegradable nanofibrous structure: a potential scaffold for blood vessel engineering, Biomaterials, 25 (2004), pp. 877-886, Elsevier Ltd.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A large variety of electrospun fibers can be produced to encapsulate a large variety of additives within the subcompartments or substructures of the manufactured electrospun fiber. Furthermore, the manufactured electrospun fibers can be electrostatically arranged within a filter component of a smoking article during the manufacturing process. By modifying the various parameters that control the electrospinning process, a diverse set of electrospun fibers can be manufactured that vary in composition, in substructural organization, and in dimension. The electrospun fiber produced by electrospinning comprises at least one type of polymeric material that encapsulates or supports the retention of at least one type of a flavorant or a non-flavorant within the electrospun fiber. A polymeric material provides a supporting structure for encapsulating at least one type of a flavorant or a non-flavorant. The electrospun fibers that can be produced by various electrospinning processes described below include microfibers in a micro-scaled range, nanofibers in a nano-scaled range, and various mixtures of microfibers and nanofibers.

7 Claims, 5 Drawing Sheets

(56) References Cited

OTHER PUBLICATIONS

Li, Dan et al., "Nanofibers of Conjugated Polymers Prepared by Electrospinning with a Two-Capillary Spinneret," Adv. Mater. 16, No. 22, Nov. 18, 2004, pp. 2062-2066.

International Preliminary Report on Patentability issued Feb. 3, 2009 for PCT/IB2007/003096.

Singapore Official Action dated Mar. 10, 2010 for Singapore Patent Appln. No. 200900352-6.

Venugopal, J. et al., "Applications of polymer nanofibers in biomedicine and biotechnology", Biosciences Information Service, Philadelphia, PA, Database Biosis [Online], Jun. 2005, XP002468108, Database accession No. PREV200510131276 (Abstract) and Applied Biochemistry and Biotechnology, vol. 125, No. 3, Jun. 2005, pp. 147-157, ISSN: 0273-2289.

International Search Report and Written Opinion dated Mar. 14, 2008 for PCT?IB2007/003096.

Examination Report dated Jul. 23, 2010 for New Zealand Patent Appln. No. 574067.

* cited by examiner

SMOKING ARTICLES ENHANCED TO DELIVER ADDITIVES INCORPORATED WITHIN ELECTROSPUN MICROFIBERS AND NONOFIBERS, AND RELATED METHODS

CROSS REFERENCE TO RELATED APPLICATION

This application claims priority under 35 USC §119(e) to U.S. Provisional Application No. 60/835,089, filed on Aug. 3, 2006, the entire content of which is hereby incorporated by reference.

BACKGROUND

The taste of mainstream smoke from smoking articles containing tobacco can be enhanced by incorporating various flavor-enhancing agents ("flavorants") as additives into smoking articles. For instance, tobacco smoke passing through a carbon sorbent material can lose favorable taste attributes. Thus, adding various flavorants back into tobacco smoke to replace lost flavorants is desirable. However, the enhancement in the taste of smoking articles by known methods is not long-lasting and may result in products having inconsistent flavor. Volatile flavors incorporated into smoking products are not stably retained. Flavorants inadvertently migrate into sorbents of cigarette filters capable of removing gas-phase constituents. Flavorants superficially applied to either the tobacco-containing portion or the packaging portion of cigarette products are irreversibly lost. Furthermore, flavorant molecules may be chemically modified at high internal temperatures generated during smoking use, and may produce byproducts that exhibit one or more undesirable tastes. Thus, there is a continuing interest in producing tobacco-containing, smoking articles that are modified to provide consistent and controlled delivery of a large variety of additives, including flavorants and/or non-flavorant additives, to smokers during use.

SUMMARY

In several embodiments, various methods for producing different types of fibers by electrospinning are described. The fibers produced by electrospinning include microfibers in a micro-scaled range, nanofibers in a nano-scaled range, and mixtures of microfibers and nanofibers. The manufactured fibers can be incorporated into various filter components for producing a large variety of flavor-enhanced smoking articles. In various embodiments, a filter component comprises a set of fibers, in which all or a portion of the fibers can be produced by electrospinning, and the fibers are arranged to align in parallel with the inflow direction of the mainstream smoke.

In another embodiment, a fiber produced by electrospinning is incorporated into a filter component of a smoking article, in which the fiber comprises at least one polymeric material that encapsulates or supports the retention of at least one type of a flavorant and/or a non-flavorant additive.

In another embodiment, a "core-shell" fiber produced by electrospinning is incorporated into a filter component of a smoking article, in which the "core-shell" fiber comprises at least one type of a flavorant and/or a non-flavorant additive as an inner core, and at least one polymeric material as an outer shell that encapsulates the contents of the inner core.

In another embodiment, a "two-phase" matrix fiber produced by electrospinning is incorporated into a filter component of a smoking article, in which the "two-phase" matrix fiber comprises at least one polymeric material in a continuous phase and at least one type of a flavorant and/or a non-flavorant additive in a dispersed phase in the form of a microemulsion.

In another embodiment, a "hollow-core" fiber produced by electrospinning is incorporated into a filter component of a smoking article, in which the "hollow-core" fiber comprises a sacrificial polymer or a non-sacrificial polymer as a shell. The interior surface of the polymeric shell bonds to at least one type of a flavorant and/or a non-flavorant additive that can be released, partially or completely, by interactions with constituents in the mainstream smoke.

In another embodiment, a "residual-core" fiber produced by electrospinning is incorporated into a filter component of a smoking article, in which the "residual-core" fiber comprises a sacrificial polymer or a non-sacrificial polymer as a core. The exterior surface of the polymeric core bonds to at least one type of a flavorant and/or a non-flavorant additive.

DETAILED DESCRIPTION

Figure 1:
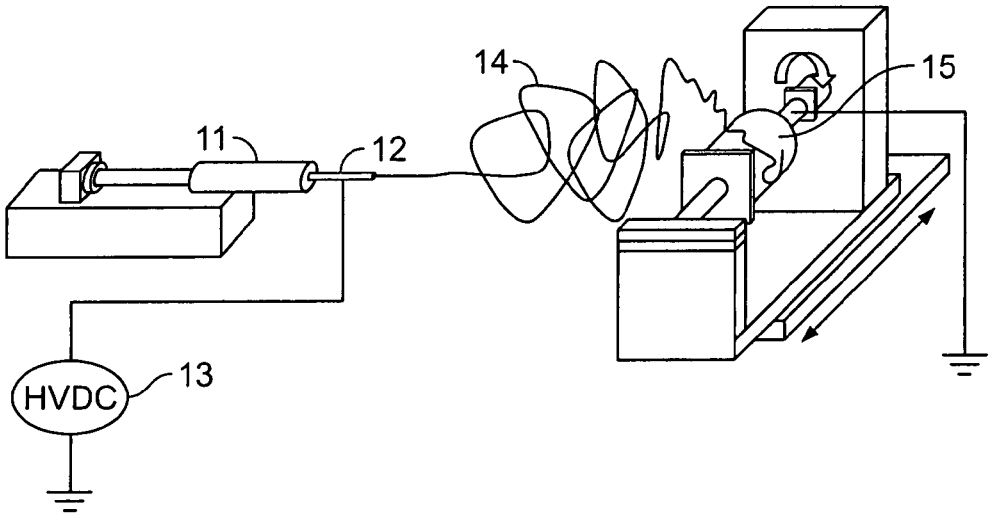
FIG. 1 is a schematic of an exemplary electrospinning apparatus for producing fibers.

Smoking articles containing tobacco, such as cigarettes, can be manufactured to contain various additives, including flavorants and non-flavorant additives such as cooling agents, diluents, and aerosol formers, that can be added directly to a tobacco blend during processing. An improved method is provided for stabilizing the incorporation of additives into such smoking articles by encapsulating the additive molecules into stable forms of fiber, and by incorporating a large number of such stable fibers into various subsections of smoking articles. The described methods can produce smoking articles containing additives that exhibit an increased shelf life so that such smoking products can deliver more flavor to users compared to smoking products manufactured by other known methods.

Various embodiments of the present invention provide methods for introducing additives of interest into a filter component of a smoking article by incorporating fibers that encapsulate a large variety of additives within the subcompartments or substructures of the manufactured fibers. Furthermore, the manufactured fibers can be electrostatically arranged within a filter component of a smoking article during the manufacture process. By modifying the various parameters that control the electrospinning process, a diverse set of fibers can be manufactured that vary in composition, in substructural organization, and in dimension. Additives suitable for incorporation into various filter components of smoking articles include flavor-enhancing agents ("flavorants") and/or any agent exhibiting chemical or physical properties of interest ("non-flavorants") that may be optionally included within the manufactured fibers to achieve a desired product. Examples of non-flavorants include cooling agents, diluents, aerosol formers, and many other equivalents.

In the present disclosure, the terms "fiber" or "fibers" refer to a material, or a form of a material, that can be produced by electrospinning processes. The material comprises at least one polymeric material that encapsulates or supports the retention of at least one type of a flavorant or a non-flavorant within the fiber. The polymeric material provides a supporting structure for encapsulating at least one type of flavorant or non-flavorant additive. The fibers that can be produced by various electrospinning processes described below include "microfibers" in a micro-scaled range (measured in units of micrometer or μm), "nanofibers" in a nano-scaled range (measured in units of nanometer or nm), and various mixtures of microfibers and nanofibers. The microfibers in the micro-scaled range include fibers having an outer diameter from about 100 nm to about 50 μm, from about 100 nm to about 40 μm, from about 100 nm to about 30 μm, from about 100 nm to about 20 μm, from about 100 nm to about 10 μm, from about 100 nm to about 5 μm, from about 100 nm to about 4 μm, from about 100 nm to about 3 μm, from about 100 nm to about 2 μm, from about 100 nm to about 1 μm. The nanofibers in the nano-scaled range include fibers having an outer diameter from about 1 nm to about 100 nm, from about 1 nm to about 95 nm, from about 1 nm to about 90 nm, from about 1 nm to about 85 nm, from about 1 nm to about 80 nm, from about 1 nm to about 75 nm, from about 1 nm to about 70 nm, from about 1 nm to about 65 nm, from about 1 nm to about 60 nm, from about 1 nm to about 55 nm, from about 1 nm to about 50 nm, from about 1 nm to about 45 nm, from about 1 nm to about 40 nm, from about 1 nm to about 35 nm, from about 1 nm to about 30 nm, from about 1 nm to about 25 nm, from about 1 nm to about 20 nm, from about 1 nm to about 15 nm, from about 1 nm to about 10 nm, from about 1 nm to about 5 nm. In one preferred embodiment, the fibers have an outer diameter in a range from about 20 nm to about 10 μm. In another preferred embodiment, the fibers have an outer diameter in a range from about 20 nm to about 3 μm.

FIG. 1 is a schematic of an exemplary electrospinning apparatus for producing fibers. In FIG. 1, the exemplary apparatus includes a source for providing a continuous supply of a flowable material that must pass through a syringe pump 11 and a syringe needle 12. An electrostatic field is generated by a DC high-voltage power source 13 applied to the syringe needle 12. From the electrostatic field, the flowable material that emerges is an unstable, continuous jet of material in the form of a fiber 14 that can be attached to a grounded, cylindrical target collector 15. The grounded target collector 15 is capable of rotation and translation along its axis.

Figure 2A:
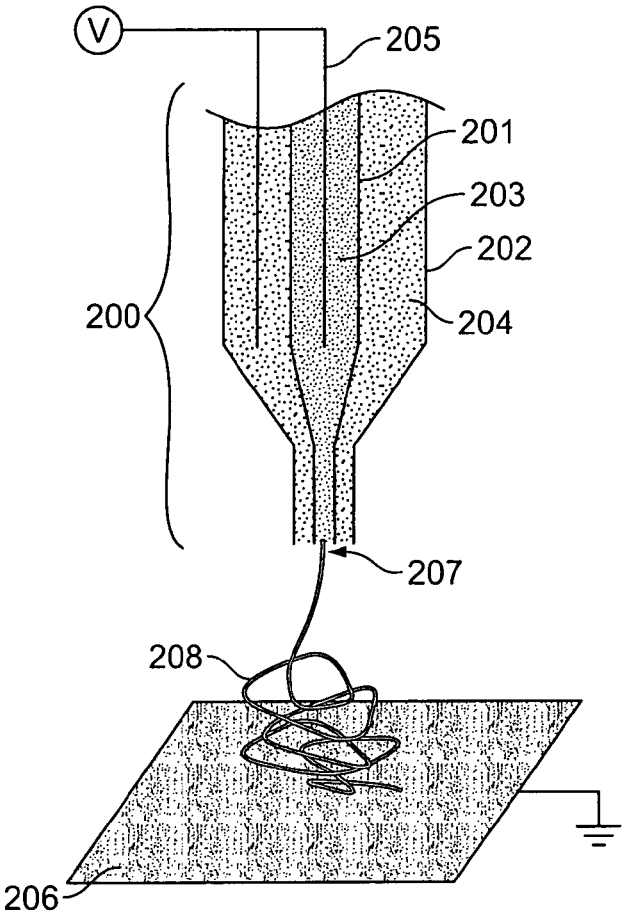
FIG. 2A is a schematic of a co-axial electrospinning apparatus for producing multi-component fibers.

FIG. 2A is a schematic of a co-axial electrospinning apparatus for producing multi-component fibers. In FIG. 2A, a spinneret 200 is shown comprising two co-axial capillaries, in which an inner capillary 201 along the center axis is loaded with a first material 203 that forms a core of a fiber, and an outer capillary 202 concentrically surrounding the inner capillary 201 is loaded with a second material 204 that forms the outer shell of a fiber. Within the spinneret 200, the flowable materials 203 and 204 are under capillary forces. The flowable materials 203 and 204 in both capillaries can be maintained at a high potential relative to a grounded target 206 such as a collection plate, for example. The first flowable material 203 of the inner capillary 201 and the second flowable material 204 of the outer capillary 202 can exit the terminal edge 207 of both capillaries, or a nozzle, and can be extruded as a single fiber 208. The terminal edge 207 of both capillaries can be positioned proximately, nominally, and concentrically at an equal distance from the grounded target 206. The first material 203 and the second material 204 within the capillaries can be maintained at a desired potential by applying the potential to a conductive spinneret, in which each capillary is conductive but electrically isolated from the other capillary. Alternatively, the first and second materials, 203 and 204 respectively, within the capillaries can be maintained at a desired potential by applying the potential to conductive electrodes 205 that can be inserted directly into the material contained within each capillary. When the electrodes are conductive, the capillaries may be conductive or non-conductive.

In FIG. 2A, the co-axial electrospinning apparatus includes a spinneret that includes a capillary or a set of co-axial capillaries, in which each subset of capillaries may be designated to extrude different flowable materials. During the electrospinning process, a stream of material is drawn out from one or more flowable materials by applying a strong electric field to droplets of flowable material formed at the opening of a spinneret. A charge is induced into the material through contact with either a high-voltage electrode within the capillary, or with the capillary itself. The application of a high voltage imparts a surface charge on droplets and elongates the droplets into fiber form. At sufficiently high voltage, a Taylor Cone can be formed in which a continuous jet of material is ejected from the tip of the cone. Within the Taylor Cone, fibers having narrow diameters can be produced by simultaneously stretching and elongating the stream of material ejected from a spinneret. The fibers produced by electrospinning can be deposited onto a grounded target collector. Upon deposition, such fibers can be aligned with appropriate alignment techniques known to persons skilled in the art of fiber preparation.

In general, additives selected for incorporation into fibers include any material that can be extruded through a spinneret. In one embodiment, additives suitable for extrusion include non-viscous forms of polymers, gels, liquids, or melts. In another embodiment, additives suitable for extrusion include viscous forms of polymers, gels, liquids, or melts that can be combined with solvents, emulsifiers, or polymerizers to achieve a desired viscosity. Solvents capable of dissolving an additive of interest and capable of producing a flowable material are suitable for electrospinning processes. For example, suitable solvents include N,N-Dimethyl formamide (DMF), tetrahydrofuran (THF), methylene chloride, dioxane, ethanol, chloroform, water, equivalent solvents, and various combinations thereof. To obtain a desired surface tension of an electrospinning fluid, various surfactants, salts, and mixtures thereof can be added to the electrospinning fluid exhibiting electric conductivity at the lowest range. For example, lithium chloride is suitable as an inorganic salt that can be added to the electrospinning fluid to increase the electric conductivity of the fluid and is removed by evaporation during the electrospinning process. If menthol is included as an additive of interest, the menthol is preferably combined with a liquid solvent, such as an oil or an emulsifier, to achieve the desired viscosity prior to the extrusion step. Alternatively, materials can be pre-heated or heated during the electrospinning process to achieve the desired viscosity. In another embodiment, suitable additives for extrusion include materials in a solid form. For example, menthol is readily available as a solid, and can be employed in a solid form as an additive in manufacturing fibers for incorporation into smoking articles so that a desired amount of menthol can be released through the mainstream smoke during smoking.

For embodiments directed to various fibers described herein, the fibers comprise "sacrificial polymers" and/or "nonsacrificial polymers." Sacrificial polymers can be modified in at least two ways, by thermal transition that results in a reversible change in the physical state of the polymer due to an increase in the temperature of the filter component of a smoking article (i.e., melting of the polymer from a solid state to a liquid state), and by chemical decomposition that results in an irreversible chemical change of the polymer due to interactions with constituents of mainstream smoke of a smoking article at elevated temperatures reached during smoking. Non-sacrificial polymers are also subject to chemical decomposition upon interactions with constituents of mainstream smoke of a smoking article at elevated temperatures reached during smoking. By controlling the composition of the fiber, a suitable combination of sacrificial polymers and non-sacrificial polymers may be employed to produce a fiber that selectively releases various additives from the retention or encapsulation within a filter component, mediated by sacrificial and non-sacrificial polymers.

Sacrificial polymers incorporated into the fibers can undergo a thermal transition that reduces the structural integrity of a sacrificial polymer when the temperature of the filter component exceeds the glass transition temperature or the melting temperature of the sacrificial polymer. The sacrificial polymer that can be subjected to thermal transition, by heating for example during the manufacturing process, is selected from the group consisting of: polyetherketone, polyoxytrimethylene, atactic polypropylene, low density polyethylene, poly(alkyl siloxane), poly(butylene adipate), polyacrylate, polymethacrylate, and polyitaconate. Suitable polymers include water-soluble polymers, or hydrolyzable polymers, such as poly(ethylene oxide) (PEO), polylactide (PLA), polyglycolide (PGA), polycaprolactone (PCL), polyhydroxybutyrate (PHB), polyhydroxyvalerate (PHBV), polyvinyl alcohol (PVA), and various polyanhydrides. Other homopolymers known by persons skilled in the art can be employed as sacrificial polymers. In one embodiment, the structural integrity of the sacrificial polymer subjected to thermal transition is reduced by at least 1% from that of the initial unsmoked state of the filter component. In a preferred embodiment, the structural integrity of the sacrificial polymer subjected to thermal transition is reduced by at least 5%, at least 10%, at least 15%, at least 20%, at least 25%, at least 30%, at least 35%, at least 40%, at least 45%, and at least 50% from that of the initial unsmoked state of the filter component.

Sacrificial polymers incorporated into the fibers can undergo a chemical decomposition that reduces the structural integrity of a sacrificial polymer when the temperature of the filter component reaches a sufficient temperature to break chemical bonds of the sacrificial polymer. For example, chemical decomposition can result in the decomposition of polymers to monomers and in the cleavage of functional groups from monomers. Suitable sacrificial polymers that can undergo a chemical decomposition include polymers that can be subjected to thermal decomposition at a sufficiently high temperature such as various thermally degradable polymers and thermally degradable epoxy resins, including starch-based thermally degradable polymers. Examples of suitable polymers include linear polymers, star polymers, and cross-linked polymers. Suitable polymer for use as a sacrificial polymer includes any type of polymer that can be subjected to chemical decomposition under high temperatures reached within the smoking filter component during smoking and/or can interact with constituents of a mainstream smoke during smoking. In one embodiment, the structural integrity of the sacrificial polymer subjected to chemical decomposition is reduced by at least 1% from that of the initial unsmoked state of the filter component. In a preferred embodiment, the structural integrity of the sacrificial polymer subjected to chemical decomposition is reduced by at least 5%, at least 10%, at least 15%, at least 20%, at least 25%, at least 30%, at least 35%, at least 40%, at least 45%, and at least 50% from that of the initial unsmoked state of the filter component.

Copolymers known by persons skilled in the art can be employed as sacrificial polymers. Suitable copolymers for producing a sacrificial polymer include copolymers composed of monomers of homopolymers described above and copolymers comprising both monomers of homopolymers described above and monomers of other types of polymers known to persons skilled in the art. Examples of suitable copolymers include random copolymers, graft copolymers, and block copolymers.

By controlling the parameters that regulate an electrospinning process, a large variety of fibers exhibiting specialized characteristics can be produced. A spinneret-target collector voltage, Vsc, may be set in the 2-20 kV range, and is preferably set in the 5-15 kV range. The distance between the charged tip of the capillaries and the grounded target can be set from about 3-25 cm, and is preferably set from about 5-20 cm. A feed rate for a polymer solution can be set from about 0.02-2.0 mL/hr, and a preferred feed rate is set from about 0.05-1.0 mL/hr. The feed rate of an additive in a solution can be set from about 0.02-2 mL/hour, and a preferred feed rate is set from about 0.05-1 mL/hour. The concentration of a polymer in solution can be set from about 0.5-40 wt % range, and is preferably set from about 1-10 wt % range. The concentration of an additive can be set from about 1-100 wt % range, and is preferably set from about 10-50 wt % range. The outer diameter of the outer capillary can be set from about 0.1-5 mm, and is preferably set from about 0.2-1 mm, while the diameter of the inner capillary can be set from about 0.05-2 mm, and is preferably set from about 0.07-0.7 mm. The capillaries may be composed of stainless steel, glass, or polymers. When stainless steel or other conductive capillaries are employed, the spinneret-target collector voltage can be applied between the collector and the capillaries. If non-conductive capillaries are employed, conductive electrodes may be inserted into the liquids to promote electrical contact. Electrospinning performed according to these parameters with a liquid feed rate of 0.5 mL/hour can result in a production rate of 20-500 mg/hour of fiber.

Figure 2B:
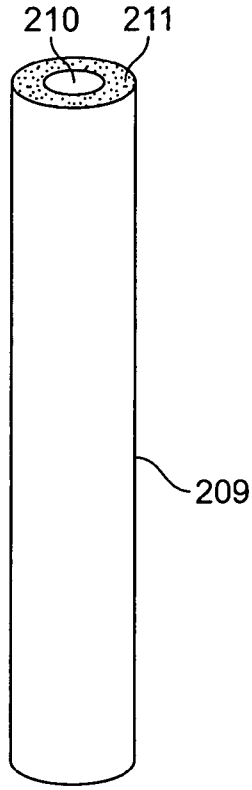
FIG. 2B is a schematic of a "core-shell" fiber produced by co-axial electrospinning.

FIG. 2B is a schematic of a "core-shell" fiber produced by co-axial electrospinning, as another embodiment. In FIG. 2B, a "core-shell" fiber 208 representing an exemplary two-component fiber illustrated in FIG. 2A is cut to a desired length to produce a subsection of the "core-shell" fiber 209. In FIG. 2A, when the inner capillary 203 is loaded to contain a flavorant and/or a non-flavorant additive as the first flowing material and the outer capillary 204 is loaded to contain a polymer as the second flowing material, the electrospinning process produces a fiber comprising a flavorant and/or a non-flavorant additive within an inner core 210, and a polymer as an outer shell 211. The fibers produced are nominally cylindrical in shape and have approximately constant diameters throughout the length of the fibers. In one preferred embodiment, the "core-shell" fibers have an outer diameter in a range from about 20 nm to about 10 μm. In another preferred embodiment, the "core-shell" fibers have an outer shell thickness in a range from about 20 nm to about 3 μm.

Various combinations of flavorants and/or other additives can be loaded within the inner capillary 201 of a spinneret as shown in FIG. 2A, and can be encapsulated within the inner core 210 of a fiber as shown in FIG. 2B. For example, suitable flavorants include menthol, eugenol, spearmint, peppermint, cocoa, vanilla, cinnamon, licorice, citrus or other fruit flavors, and combinations thereof. Examples of non-flavorant additives include cooling agents, diluents, aerosol formers, and equivalents. In a preferred embodiment, menthol is incorporated into the fibers of smoking articles as a cooling agent and as a flavorant.

Figure 3A:
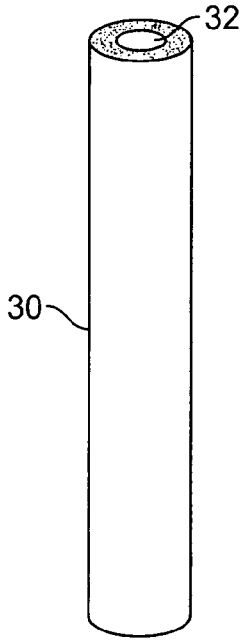
FIG. 3A is a schematic of a "core-shell" fiber produced by co-axial electrospinning, in which the fiber can be modified to encapsulate different flavorants and/or non-flavorant additives.

FIG. 3A is a schematic of a "core-shell" fiber produced by co-axial electrospinning, in which the fiber can be modified to encapsulate different flavorants and/or non-flavorant additives, as another embodiment. In FIG. 3A, an exemplary "core-shell" fiber that includes a shell 30 and a core 32 is shown. The core 32 of the "core-shell" fiber can be designed to encapsulate one or more flavorants and/or non-flavorant additives into distinct sub-compartments so that the content of the sub-compartments remains separated as long as the integrity of the "core-shell" fiber is not compromised. The core 32 of the "core-shell" fiber can be designed so that multiple flavorants and/or non-flavorant additives are alternatively arranged as illustrated and as described in FIG. 3B below.

Figure 3B:
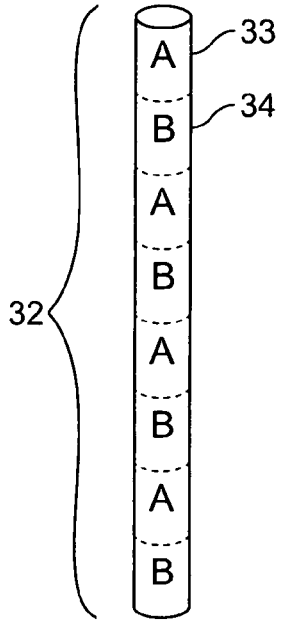
FIG. 3B is a schematic of a partially exploded view of the core of the "core-shell" fiber illustrated in FIG. 3A, in which the core contains two different flavorants and/or non-flavorant additives.

FIG. 3B is a schematic of a partially exploded view of the core of the "core-shell" fiber illustrated in FIG. 3A, in which the core contains two different flavorants and/or non-flavorant additives, as another embodiment. In FIG. 3B, two different additives, "A" and "B," in a desired amount can be consecutively loaded within a single interior capillary to produce a fiber comprising at least two different additives, "A" 33 and "B" 34, alternatively arranged within the interior core of the fiber. In one embodiment, a fiber comprises flavorants "A" and "B" alternatively arranged within the interior core of a fiber along the length of the fiber. As a preferred embodiment, the interior capillary is loaded with menthol as an additive and the exterior capillary is loaded with a sacrificial polymer in order to produce a fiber that encapsulates methanol into the core of the polymeric fiber.

The flavorants and/or non-flavorant additives encapsulated into the fibers can be arranged along the length of the fiber to release a flavorant or a non-flavorant additive in an amount sufficient to produce the effect desired in each puff of a smoking article. For example, if two different additives are alternatively arranged as illustrated in FIG. 3B, then flavorant "A" can be released during the first puff, flavorant "B" can be released during the second puff, and flavorant "A" can be released during the third puff, and so on until the smoking article has been completely exhausted. In a preferred embodiment, a "core-shell" fiber can be designed to encapsulate a predetermined amount of each additive within a sub-compartment of the core that correlates with an average amount of the additive intended to be released from encapsulation by a single puff of a smoking article. Additives "A" and "B" can be arranged as a set so that the number of sets of additives "A" and "B" can equal the maximum number of puffs that can be obtained in a smoking article so that both flavorants "A" and "B" can be enjoyed together in a single puff. For example, if eight puffs can be obtained for an average cigarette length, then a "core-shell" fiber of a given length that contains repeats of eight "AB" sets or a set of "AB-AB-AB-AB-AB-AB-AB-AB" can be designed. Alternatively, a "core-shell" fiber can be designed to contain multiple repeats of "AB" set in which the number of "AB" sets repeated along the length of the fiber is less than the maximum number of puffs obtainable for a given cigarette length. For example, a fiber comprising two flavorants "AB," in which a first portion of a fiber of a given length comprises flavorant "A" and a second portion of the same fiber comprises flavorant "B" is also contemplated. In another embodiment, additives "A," "B," "C," and "D" can be arranged as a set so that the number of sets of additives "AB" and "CD" can equal the maximum number of puffs that can be obtained in a smoking article so that flavorants "A," "B," "C," and "D" can be enjoyed together in a single puff. For example, if eight puffs can be obtained for an average cigarette length, then a "core-shell" fiber of a given length that contains repeats of eight alternating sets of "AB" and "CD" or a set of "AB-CD-AB-CD-AB-CD-AB-CD-AB-CD-AB-CD-AB-CD-AB-CD" can be designed.

Figure 4A:
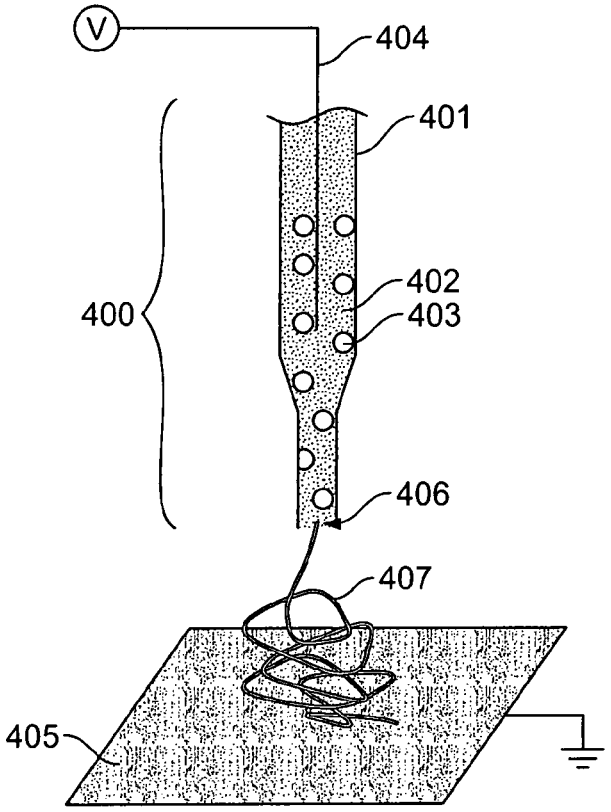
FIG. 4A is a schematic of a spinneret that includes a single capillary that can extrude a "two-phase" matrix fiber produced by co-axial electrospinning.

FIG. 4A is a schematic of a spinneret that includes a single capillary that can extrude a "two-phase" matrix fiber produced by co-axial electrospinning, as another embodiment. In FIG. 4A, a first material comprising a sacrificial polymer 402 and a second material 403 comprising a flavorant and/or a non-flavorant additive can be loaded into a single-capillary spinneret 400 that includes a single capillary 401. Within the capillary 401, the first material comprising the sacrificial polymer 402 is formed in a continuous phase, and the second material comprising a flavorant and/or a non-flavorant additive 403 is formed in a dispersed phase. The first and second materials, 402 and 403 respectively, are combined as a micro-emulsion, and the mixture is maintained at a desired potential by applying a potential to the conductive electrode 404 inserted directly into the mixture of materials contained within the capillary. The potential of the conductive electrode is relative to the potential of a collection plate that serves as a grounded target 405. The "two-phase" matrix material representing a mixture of the two materials exits the nozzle 406. The "two-phase" matrix fiber 407 produced by the electrospinning process can be collected on the grounded target.

Figure 4B:
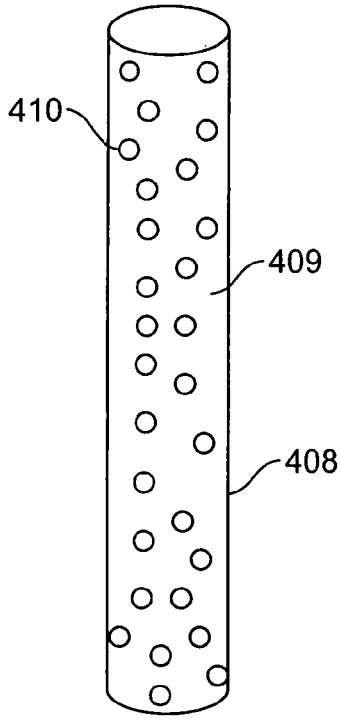
FIG. 4B is a schematic of a partially exploded view of the "two-phase" matrix fiber illustrated in FIG. 4A, in which the "two-phase" matrix fiber comprises a polymer matrix as a first phase and a droplet of flavorants and/or non-flavorant additives as a second phase.

FIG. 4B is a schematic of a partially exploded view of the "two-phase" matrix fiber illustrated in FIG. 4A, in which the "two-phase" matrix fiber comprises a polymer matrix as a first phase and a droplet of flavorants and/or non-flavorant additives as a second phase, as another embodiment. In FIG. 4B, an exemplary "two-phase" matrix fiber 407 illustrated in FIG. 4A is cut to a desired length to produce a subsection of the "two-phase" matrix fiber 408. As a result of the electrospinning process, the first material comprising the sacrificial polymer 402 illustrated in FIG. 4A, and the second material comprising at least one type of a flavorant and/or a non-flavorant additive 403 illustrated in FIG. 4A are combined to produce a "two-phase" matrix fiber comprising a matrix of sacrificial polymer formed as a continuous phase 409, and a droplet of flavorants and/or non-flavorant additives formed as a dispersed phase 410. When "two-phase" matrix capsules within a filter component of a smoking article become exposed to a mainstream smoke containing particulates, including water vapor, the flavorants and/or non-flavorant additives dispersed throughout the matrix structure comprising a sacrificial polymer are gradually released due to processes of thermal transition and/or chemical decomposition of the sacrificial polymer during smoking.

Figure 5C:
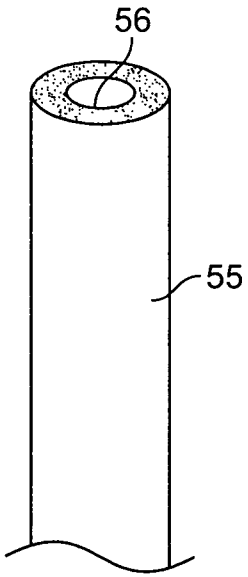
FIG. 5C is a schematic of a "hollow-core" fiber produced after removing the core section of the "core-shell" fiber illustrated in FIG. 5B.
Figure 5B:
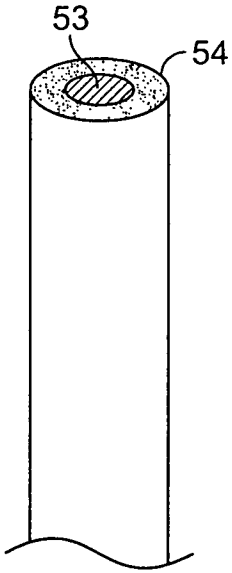
FIG. 5B is a schematic of a "core-shell" fiber produced by co-axial electrospinning that can be further modified to produce a "hollow-core" fiber.
Figure 5A:
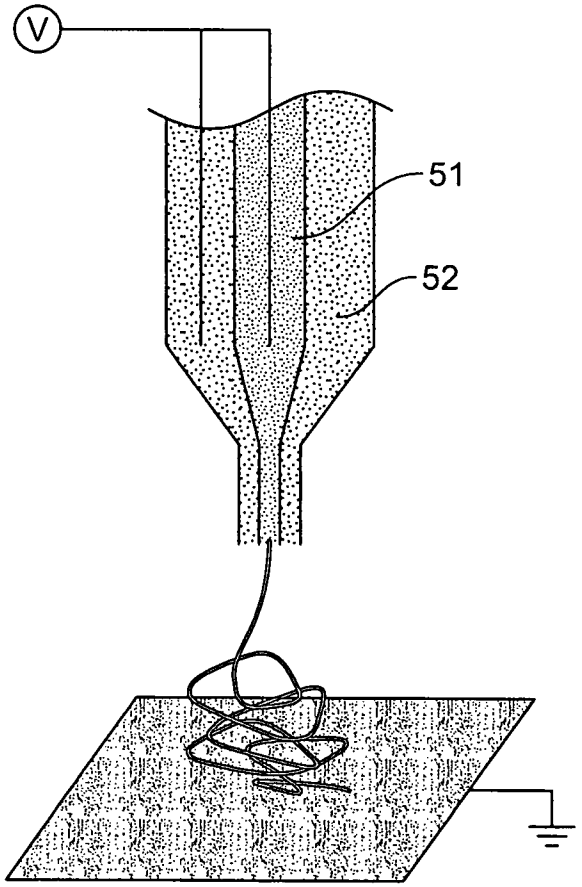
FIG. 5A is a schematic of a co-axial electrospinning apparatus for producing "hollow-core" fibers.

FIG. 5A is a schematic of a co-axial electrospinning apparatus for producing "hollow-core" fibers. In FIG. 5A, an inner capillary is loaded with a single-phase mixture 51 of flavorants and/or non-flavorant additives combined with a sacrificial polymer. The sacrificial polymer can be employed in the form of a gel, a liquid, or a melt. An outer capillary is loaded with a polymer solution 52 comprising a non-sacrificial polymer.

FIG. 5B is a schematic of a "core-shell" fiber produced by co-axial electrospinning that can be further modified to produce a "hollow-core" fiber, as another embodiment. In FIG. 5B, the non-sacrificial polymeric material 52 loaded into the outer capillary illustrated in FIG. 5A forms the polymeric shell 54 of the fiber, and the single-phase mixture 51 illustrated in FIG. 5A forms the sacrificial core 53 of the fiber. During the electrospinning process or during subsequent steps such as annealing, the additive molecules within the core 53 of the fiber can interact with the polymeric shell 54, either chemically or physically, such that the additive molecules bind to the surface of the polymeric shell exposed to the additive. The interaction between the additive and the polymeric shell is sufficiently strong so that the bound additive molecules remain attached to the surface of the polymeric shell when the core is removed subsequently. In FIG. 5B, the core 53 of the "core-shell" fiber can be removed by a degradation reaction to produce a "hollow-core" fiber comprising a polymer formed as a cylindrical shell, in which the internal surface of the cylindrical shell is bound with molecules of flavorants and/or non-flavorant additive 55. The core 53 can be removed by chemical decomposition and/or thermal transition. The core 53 of the "core-shell" fiber can be removed by thermal treatment during the electrospinning process by elevating the temperature of the fiber before the fiber reaches the target collector. If the core 53 contains a solvent, the content of the core 53 can be removed by evaporating the solvent at elevated temperatures. Alternatively, the core 53 can be removed by chemical decomposition and/or thermal transition after the electrospinning process, either before or after the fibers have been cut to the preferred length.

FIG. 5C is a schematic of a "hollow-core" fiber produced after removing the core section of the "core-shell" fiber illustrated in FIG. 5B, as another embodiment. In FIG. 5C, the "hollow-core" fiber comprises flavorants and/or non-flavorant additives attached to the interior surface 56 of the polymeric shell 55. During smoking, the flavorants and/or non-flavorant additives can be released from the "hollow-core" fiber by mainstream smoke constituents that interfere with the bonding between the interior surface 56 and the flavorants and/or non-flavorant additives. As one embodiment, a "hollow-core, non-sacrificial shell" fiber is produced by co-axial electrospinning process, in which the "hollow-core, non-sacrificial shell" fiber comprises a non-sacrificial polymer formed as a shell and at least one type of a flavorant and/or a non-flavorant additive bonded to an interior surface of the shell.

As another embodiment, a sacrificial "hollow-core, sacrificial shell" fiber is produced by co-axial electrospinning process, in which the "hollow-core, sacrificial shell" fiber comprises a sacrificial polymer formed as a shell and at least one type of a flavorant and/or a non-flavorant additive bonded to an interior surface of the shell, in which the flavorants and/or non-flavorant additives are released from the "hollow-core, sacrificial shell" fiber when exposed to mainstream smoke. An inner capillary can be loaded with a single-phase mixture of flavorants and/or non-flavorant additives combined with a sacrificial polymer. The sacrificial polymer can be employed in the form of a gel, a liquid, or a melt. In addition, an outer capillary can be loaded with a polymer solution comprising a sacrificial polymer. The sacrificial polymeric material loaded into the outer capillary forms a sacrificial polymeric shell of the fiber, and the single-phase mixture forms the sacrificial core of the "hollow-core, sacrificial shell" fiber. The degradation of the sacrificial polymeric shell can be performed by a different manner from the degradation of the sacrificial polymeric core. For example, if the polymer selected for forming the core of the "hollow-core, sacrificial shell" fiber has a relatively lower melting temperature than the sacrificial polymer selected for forming the shell of the "hollow-core, sacrificial shell" fiber, the sacrificial polymeric core may be removed by thermal transition at an elevated temperature during the manufacturing process, and the sacrificial polymeric shell may be chemically decomposed during subsequent use by smokers. The sacrificial polymeric core may be thermally removed during the manufacturing process at a moderately high temperature that selectively melts the polymer of the core and that does not melt the polymer of the shell to maintain the structural integrity of the shell. The sacrificial polymeric shell may be chemically decomposed during smoking, in which the constituents of mainstream smoke chemically decompose the shell, causing the release of flavorants and/or non-flavorant additives from the interior surface of the shell.

Figure 6C:
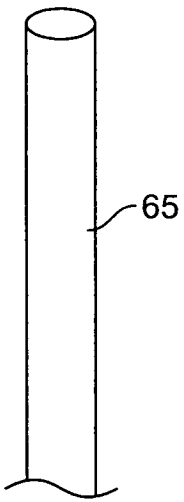
FIG. 6C is a schematic of a "residual-core" fiber produced after removing the shell section of the "core-shell" fiber illustrated in FIG. 6B.
Figure 6B:
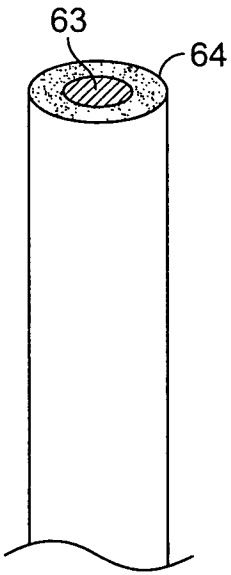
FIG. 6B is a schematic of a "core-shell" fiber produced by co-axial electrospinning that can be further modified to produce a "residual-core" fiber.
Figure 6A:
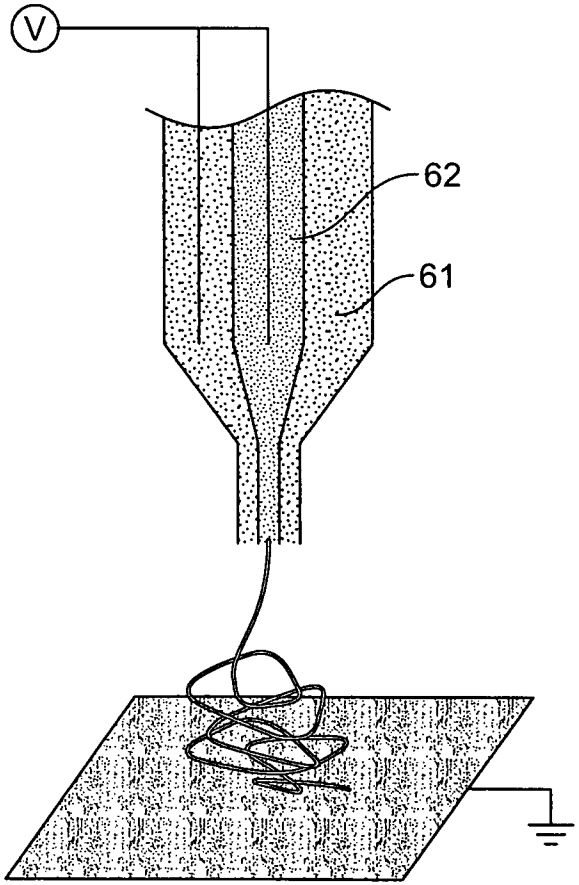
FIG. 6A is a schematic of a co-axial electrospinning apparatus for producing "residual-core" fibers.

FIG. 6A is a schematic of a co-axial electrospinning apparatus for producing "residual-core" fibers. In FIG. 6A, an inner capillary is loaded with a polymer solution 62 comprising a sacrificial polymer or a non-sacrificial polymer. An outer capillary is loaded with a single-phase mixture 61 of flavorants and/or non-flavorant additives combined with a sacrificial polymer. The sacrificial polymer can be employed in the form of a gel, a liquid, or a melt.

FIG. 6B is a schematic of a "core-shell" fiber produced by co-axial electrospinning that can be further modified to produce a "residual-core" fiber, as another embodiment. In FIG. 6B, the single-phase mixture 61 loaded into the outer capillary illustrated in FIG. 6A forms the sacrificial shell 64 of the "non-sacrificial, residual-core" fiber, and the non-sacrificial polymeric material 62 illustrated in FIG. 6A forms the residual core 63 of the "non-sacrificial, residual-core" fiber. During the electrospinning process or during subsequent steps such as annealing, the additive molecules within the shell 64 of the residual-core fiber can interact with the residual core 63 exposed to additive molecules, either chemically or physically, such that the additive molecules can bind to the surface of the residual core 63 exposed to the additive. The interaction between the additive and the residual core 63 is sufficiently strong so that the bound additive molecules remain attached to the surface of the residual core 63 when the shell 64 is removed subsequently. In FIG. 6B, the shell 64 of the "core-shell" fiber produced in an initial step can be removed to produce a "residual-core" fiber 65 comprising a polymer formed as a core, in which the exterior surface of the core is bound with molecules of flavorants and/or non-flavorant additives. The shell 64 can be removed by chemical decomposition and/or thermal transition. The shell 64 of the "core-shell" fiber can be removed by thermal treatment, such as heating, during the electrospinning process by elevating the temperature of the fiber before the fiber reaches the target collector. If the shell 64 contains a solvent, the content of the shell 64 can be removed by evaporating the solvent at elevated temperatures. Alternatively, the shell 64 can be removed by a reaction that causes chemical decomposition and/or thermal transition after the electrospinning process.

FIG. 6C is a schematic of a "residual-core" fiber produced after removing the shell of the "core-shell" fiber illustrated in FIG. 6B, as another embodiment. In FIG. 6C, the "residual-core" fiber comprises flavorants and/or non-flavorant additives attached to the exterior surface of the polymeric core 65. During smoking, the flavorants and/or non-flavorant additives can be released from the "residual-core" fiber by mainstream smoke constituents that interfere with the bonding between the exterior surface 65 and the flavorants and/or non-flavorant additives. As one embodiment, a "non-sacrificial, residual-core" fiber is produced by co-axial electrospinning process, in which the "non-sacrificial, residual-core" fiber comprises a non-sacrificial polymer formed as a core and at least one flavorant and/or non-flavorant additive bonded to an external surface of the core, in which the flavorant and/or non-flavorant additive is supported by a sacrificial outer polymeric shell. As another embodiment, a "sacrificial, residual-core" fiber is produced by co-axial electrospinning process, in which the "sacrificial, residual-core" fiber comprises a sacrificial polymer formed as a core and at least one flavorant and/or non-flavorant additive bonded to an external surface of the core, in which the flavorant and/or non-flavorant additive is supported by a sacrificial outer polymeric shell.

Further processing steps may be performed after the electrospinning process to prepare the electrospun fibers for incorporation into components of smoking articles. For example, the "core-shell" fibers, the "two-phase" matrix fibers, and the "hollow-core" fibers can be cut to produce fibers having a length in a range from about 1 mm to about 20 mm. Fibers for incorporation into a particular filter type can be cut to approximately the same length. For incorporating the fibers into a filter of a smoking article, the fibers can be gathered into a bundle prior to insertion into the manufactured smoking article. If the fibers are bundled, the fibers can be held together using a permeable, semi-permeable, or impermeable material, or an enclosure such as a ring, or an adhesive such as a triacetin, an epoxy, and a silicone rubber. In alternative embodiments, the fibers are gathered into a bundle before cutting the fibers to a desired length.

In another embodiment, flavorants and/or non-flavorant additives are incorporated into "hollow-core" fibers after an electrospinning process is employed for producing a polymer shell. For example, for alternatively producing a "hollow-core" fiber, the inner capillary can be loaded with a sacrificial polymer in the form of a gel, a liquid, or a melt, but need not be loaded additionally with a flavorant and/or a non-flavorant additive. The sacrificial polymer of the core can be subjected to thermal transition or chemical decomposition before a subsequent step that soaks the fiber into a solution of a flavorant and/or a non-flavorant additive to adhere the flavorant and/or the non-flavorant additive to the exposed surfaces of the "hollow-core" fibers. Additives attached to the interior surface of the shell can be retained and the additives attached to the outer surface of the shell that forms a "hollow-core" fiber may be removed by evaporation or by other means. The flavorants and/or non-flavorant additives stably bound to "hollow-core" fibers can be released when exposed to constituents of mainstream smoke during use by smokers.

In another embodiment, flavorants and/or non-flavorant additives are incorporated into "residual-core" fibers after an electrospinning process is employed for producing a polymer core. For example, for alternatively producing a "residual-core" fiber, the outer capillary can be loaded with a sacrificial polymer in the form of a gel, a liquid, or a melt, but need not be loaded additionally with a flavorant and/or a non-flavorant additive. The sacrificial polymer of the shell can be subjected to chemical decomposition or thermal transition before a subsequent step that soaks the fiber in a solution of a flavorant and/or a non-flavorant additive to adhere to the exposed surfaces of the "residual-core" fibers. The flavorants and/or non-flavorant additives stably bound to the fibers can be released when exposed to constituents of mainstream smoke during use by smokers.

Figure 7A:
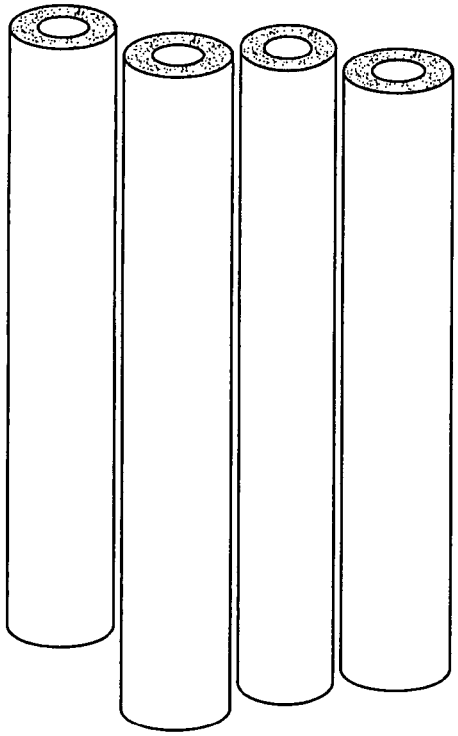
FIG. 7A is a schematic of a set of fibers in alignment.
Figure 7B:
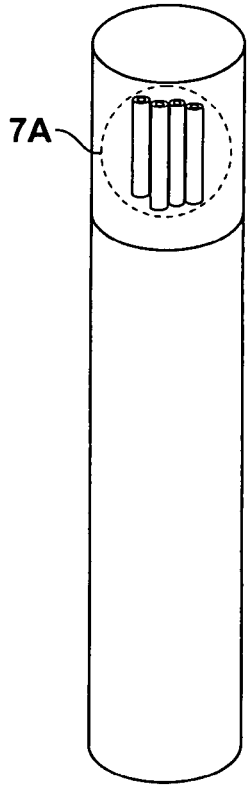
FIG. 7B is a schematic of a partially exploded perspective view of a cigarette showing an arrangement of a set of fibers in alignment within a cigarette filter.

FIG. 7A is a schematic of a set of fibers in alignment, as another embodiment. FIG. 7B is a schematic of a partially exploded perspective view of a cigarette showing an arrangement of a set of fibers in alignment within a cigarette filter. The fibers produced by electrospinning are predominantly in alignment with the long axis of a cigarette, and therefore, are also in alignment with the inflow of mainstream smoke. Such alignment of the fibers promotes maximum interaction between the mainstream smoke and the core material, and promotes efficient controlled release of additives. In various embodiments, a smoking article that includes a filter component composed of a fiber produced by electrospinning is provided, in which the fiber comprises at least one polymeric material that encapsulates or supports the retention of at least one type of a flavorant and/or a non-flavorant additive. In another embodiment, a smoking article that includes a filter component composed of a "core-shell" fiber produced by electrospinning is provided, in which the "core-shell" fiber comprises at least one type of a flavorant and/or a non-flavorant additive as an inner core, and at least one polymeric material as an outer shell that encapsulates the contents of the inner core. In another embodiment, a smoking article that includes a filter component composed of a "two-phase" matrix fiber produced by electrospinning is provided, in which the "two-phase" matrix fiber comprises at least one polymeric material in a continuous phase and at least one type of a flavorant and/or a non-flavorant additive in a dispersed phase in the form of a micro-emulsion. In another embodiment, a smoking article that includes a filter component composed of a "hollow-core" fiber produced by electrospinning is provided, in which the "hollow-core" fiber comprises a sacrificial polymer or a non-sacrificial polymer as a shell. In another embodiment, a smoking article that includes a filter component composed of a "residual-core" fiber produced by electrospinning is provided, in which the "residual-core" fiber comprises a sacrificial polymer or a non-sacrificial polymer as a core. With respect to various types of fibers described herein, the filter components and smoking articles that incorporate such types of fibers exhibit the properties described for the different types of fibers. For example, the content of the inner core of a "core-shell" fiber can be released when the structural integrity of the polymeric material that forms the shell is reduced or eliminated by chemical decomposition and/or thermal transition.

Figure 8:
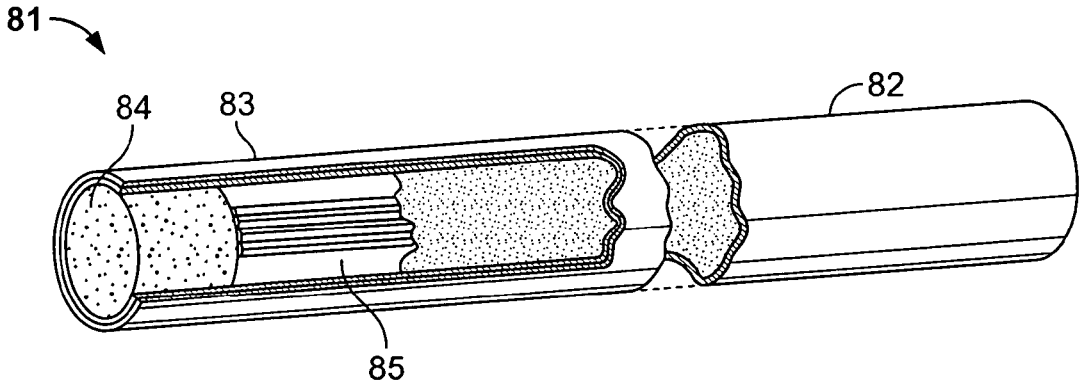
FIG. 8 is a schematic of a partially exploded perspective view of a cigarette showing various subsections of a cigarette that can be modified to incorporate a set of fibers produced by co-axial electrospinning.

FIG. 8 is a schematic of a partially exploded perspective view of a cigarette showing various subsections of a cigarette that can be modified to incorporate a set of fibers produced by co-axial electrospinning, as another embodiment. A cigarette filter comprising such fibers can be incorporated into any type of smoking article, including various types of cigarettes containing filter-like elements. The desired amount of flavorants and/or non-flavorant additives contained in a puff of tobacco smoke can be provided in the cigarette filter component by adjusting the number of fibers employed in the cigarette filter. In FIG. 8, a cigarette 81 is illustrated that includes a tobacco rod 82, a filter component 83, and a mouthpiece filter plug 84. The filter component 83 can also be modified to create a void space into which the flavor-enhanced fibers can be inserted. The flavor-enhanced fibers can be incorporated into the mouthpiece filter plug 84 or inserted into a hollow cavity such as the interior of a free-flow sleeve 85 forming part of the filter component 83. In one embodiment, a set of fibers can be inserted into a hollow portion of the cigarette filter. In another embodiment, a set of fibers can be inserted within a hollow cavity between two or more conventional cigarette filter components such as plugs of cellulose acetate. Fibers enhanced with non-flavorant additives can be prepared as described for flavor-enhanced fibers for manufacturing smoking articles.

Figure 9:
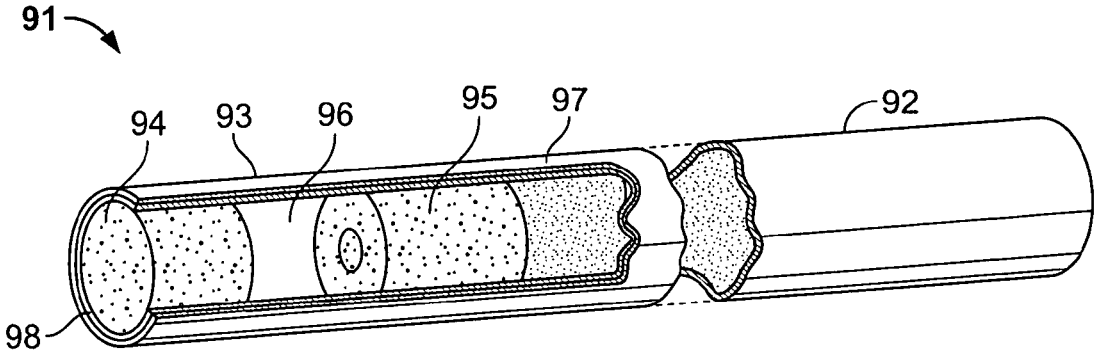
FIG. 9 is a partially exploded perspective view of a cigarette showing various subsections of a cigarette that can be modified to incorporate a set of fibers produced by co-axial electrospinning.

FIG. 9 is a partially exploded perspective view of a cigarette showing various subsections of a cigarette that can be modified to incorporate a set of fibers produced by co-axial electrospinning, as another embodiment. In FIG. 9, a cigarette 91 is illustrated that includes a tobacco rod 92 and a filter component 93 in the form of a plug-space-plug filter. The filter component 93 includes a mouthpiece filter 94, a space 96, and a plug 95. The plug can be in a form of a tube and can be composed of a solid piece of material such as polypropylene or cellulose acetate fibers. The tobacco rod 92 and the filter component 93 are joined together with tipping paper 97. The filter component 93 may include a filter overwrap 98. The flavor-enhanced fibers can be incorporated into the mouthpiece filter 94, the plug 95, and/or the space 96. The flavor-enhanced fibers can be incorporated into any element of the filter component of a cigarette so that the fibers are substantively in parallel with the long axis of the smoking article. Fibers enhanced with non-flavorant additives can be prepared as described for flavor-enhanced fibers for manufacturing smoking articles.

In general, flavorants and non-flavorant additives can be released from the surface of a fiber into mainstream smoke via any known or unknown mechanisms. Regardless of the underlying mechanism, the bonds attaching molecules of an additive to a polymeric surface of a support structure can be broken upon exposure to constituents of mainstream smoke, such as water vapor. For all described embodiments, the flavorants and/or non-flavorant additives are preferably released when the smoking articles composed of the fibers are puffed during average use by a smoker, in an amount sufficient to achieve the flavor-enhancing effect desired. If the outer polymeric shell of "core-shell" fibers and the continuous polymeric matrix of "two-phase" matrix fibers are composed of sacrificial polymers, the additives can be released when the structural integrity of the polymeric material of the support is reduced or eliminated by a physical change in the polymeric material that may occur when the glass transition temperature or the melting temperature of the shell is exceeded within the filter. In addition, the structural integrity can be compromised when the shell is chemically decomposed by constituents in the mainstream smoke causing partial or complete decomposition of the shell at elevated temperatures during smoking.

Partial decomposition of a sacrificial shell or a sacrificial matrix can be enhanced by the presence of a chemical or thermal gradient in the inflow direction of mainstream smoke. For example, if the temperature of the mainstream smoke at the tobacco rod end of a cigarette is relatively higher than the temperature at the mouthpiece end, the fibers will decompose at the distal end first (i.e., tobacco rod end) before consuming the proximal end (i.e., mouthpiece end) during puffing. If the concentration of the mainstream smoke at the tobacco rod end of a cigarette is relatively higher than the concentration at the mouthpiece end, the fibers will decompose at the distal end first (i.e., tobacco rod end) before consuming the proximal end (i.e., mouthpiece end) during puffing. By either means, the partial and progressive decomposition of the fibers can be achieved.

Fibers are useful for holding various flavorants and/or non-flavorant additives within the sub-compartments of the fibers, including the core compartment and the shell compartment. The partial or complete encapsulation provided by the fibers minimize or preclude volatilization of the additives, and decrease the amount of flavorants employed for manufacturing a smoking article. Smoking articles comprising such fibers may exhibit a reduction in "delivered total particulate matter" (TPM) when compared to standard flavored cigarettes not composed of such fibers. Smoking articles comprising such fibers may exhibit an increased shelf life by decreasing the rate of loss of additive molecules. When menthol is employed as an additive, the amount preferably released per puff is in a range from about 6.0 μg to about 2.5 mg, or more preferably, from about 25 μg to about 125 μg. The total amount of menthol in a filter of a tobacco article such as a cigarette is preferably in a range from about 0.1 mg to about 1000 mg, or more preferably in a range from about 0.5 mg to about 5 mg.

Although several embodiments have been described in reference to specific or preferred embodiments, variations and modifications of these embodiments will be apparent to persons skilled in the art. Such variations and modifications are to be considered within the purview and scope of the presented claims. Experimental procedures, materials, and expected results may need adjusting if the procedures will be scaled up or if additional factors need to be taken into consideration. The co-axial electrospinning process has been described for a laboratory-scaled level of production. Further modifications are expected for making fibers on an industry-scaled level of production.

In one embodiment, a method for producing a filter component of a smoking article comprises providing a filter support material; providing a fiber comprising at least one type of flavorant and/or a non-flavorant additive, and at least one type of polymer; and assembling together the filter support material with one or more fibers to form a filter component, wherein the polymer stabilizes the retention of at least one type of flavorant and/or a non-flavorant additive within the filter component in an initial unsmoked state, and wherein at least one type of polymer is modified by thermal transition and/or chemical decomposition so that at least one type of flavorant and/or a non-flavorant additive is released into a mainstream smoke. Suitable filter support materials are known in the art, and includes cellulose acetate and derivative thereof. Various methods for producing fibers by electrospinning are provided herein. In another embodiment, the method for producing a filter component further includes cutting the set of fibers to substantially uniform length; aligning the fibers of the set in a uniform direction; and assembling the set of aligned fibers with other elements of the cigarette filter so that the set of aligned fibers are substantially parallel in alignment with respect to the longitudinal direction of the filter component/smoking article and the inflow direction of a main stream smoke. In another embodiment, a filter component comprises from about 100 to about 1,000,000 fibers per smoking article. In another embodiment, a filter component comprises from about 200 to about 10,000 fibers per smoking article.

The following example provides a description of a double-nozzle electrospinning experiment.

Example 1

A double-nozzle co-axial electrospinning experiment was performed employing a core liquid inside a 25-gauge stainless steel tubing (OD: 0.5 mm; ID: 0.3 mm), comprising a menthol/methylene chloride (CH2Cl2) solution at a menthol concentration of about 10 wt %. The shell liquid was fed into a 19-gauge stainless steel tubing (OD: 1.07 mm: 0.81 mm), and comprised a PEO/water solution at ~1 wt % PEO with a molecular weight of 5,000,000 g/mole. The distance between the tip of the capillaries and the grounded target was 6 cm, Vsc was nominally 5 kV, the flow rate of the core solution was set to 0.05 mL/hour and the flow rate of the shell solution was set to 0.11 mL/hour. The grounded target was served by a cylinder with a diameter of 10 cm. The experiment was performed at room temperature and at atmospheric pressure.

It will be appreciated that, although specific embodiments of the invention have been described herein for purposes of illustration, various modifications may be made without departing from the spirit and the scope of the invention. Accordingly, the invention is not limited except as by the appended claims.

We claim:

1. A filter component of a smoking article, the filter component comprising:

a plurality of electrospun fibers having an inner core and an outer shell, the electrospun fiber comprising at least one type of flavorant and/or a non-flavorant additive contained in the inner core; and at least one type of polymer, wherein a substantial portion of the electrospun fibers is arranged in a parallel alignment with respect to the longitudinal direction of the filter component and in parallel alignment with respect to the direction of a mainstream smoke, wherein the polymer is a sacrificial polymer selected from the group consisting of: polyetherketone, polyoxytrimethylene, poly(alkyl siloxane), poly(butylene adipate), polyacrylate, polyitaconate, poly(ethylene oxide) (PEO), polyglycolide (PGA), polyhydroxybutyrate (PHB), polyhydroxyvalerate (PHBV), and combinations thereof, and wherein each of the electrospun fibers is a hollow-core, sacrificial shell electrospun fiber comprising:

at least one type of flavorant and/or nonflavorant combined with a first sacrificial polymer that forms the inner core of the electrospun fiber; and a second sacrificial polymer that forms the outer shell of the electrospun fiber encapsulating the inner core containing the flavorant and/or the nonflavorant and the first sacrificial polymer.

2. The filter component of claim 1, wherein each of the electrospun fibers has a substantially cylindrical cross-sectional shape, a substantially constant diameter throughout the length of the electrospun fiber, an outer diameter from about 10 nanometers (nm) to about 50 micrometers (μm), and a length from about 1 millimeters (mm) to about 20 millimeters (mm).

3. The filter component of claim 2, wherein each of the electrospun fibers has an outer diameter from about 10 nanometers (mm) to about 10 micrometers (μm), or from about 20 nanometers (mm) to about 3 micrometers (μm).

4. The filter component of claim 1, wherein the polymer stabilizes the retention of the flavorant and/or the nonflavorant additive in an initial unsmoked state.

5. The filter component of claim 1, wherein the sacrificial polymer loses structural integrity by thermal transition and/or chemical decomposition, and wherein the structural integrity is reduced by at least 1% from that of the initial unsmoked state of the filter component.

6. The filter component of claim 1, wherein each of the electrospun fibers comprises a flavorant selected from the group consisting of menthol, eugenol, spearmint, peppermint, cocoa, vanilla, cinnamon, licorice, citrus flavor, fruit flavors, and a combination thereof.

7. A smoking article comprising the filter component of claim 1.

* * * * *